US005878521A

United States Patent [19]

Warnock

[11] Patent Number: 5,878,521

[45] Date of Patent: Mar. 9, 1999

[54] STEALTH SIGHT DEVICE

[76] Inventor: Kenneth O. Warnock, 18410 Wards Ferry Rd., Sonora, Calif. 95370

[21] Appl. No.: 838,641

[22] Filed: Apr. 9, 1997

[51] Int. Cl.[6] ..... F41G 1/34

[52] U.S. Cl. ..... 42/103; 42/100; 33/241

[58] Field of Search ..... 42/103, 100; 33/233, 33/241

[56] References Cited

U.S. PATENT DOCUMENTS

| | | | |
|---|---|---|---|
| Re. 35,347 | 10/1996 | Bindon | 33/241 |
| 3,641,676 | 2/1972 | Knutsen et al. | 33/52 |
| 4,020,203 | 4/1977 | Thuler | 428/35 |
| 4,805,313 | 2/1989 | Stocker et al. | 33/241 |
| 4,877,324 | 10/1989 | Havri et al. | 356/251 |
| 5,065,519 | 11/1991 | Bindon | 33/241 |
| 5,202,524 | 4/1993 | Nechushtan | 42/100 |
| 5,359,800 | 11/1994 | Fisher et al. | 42/103 |
| 5,404,667 | 4/1995 | Schmitter | 42/100 |
| 5,467,552 | 11/1995 | Cupp et al. | 42/100 |

*Primary Examiner*—Harold J. Tudor
*Assistant Examiner*—Meena Chelliah

[57] ABSTRACT

A stealth sight device including a front sight that has a housing positioned on a front mounting portion. The front mounting portion is positioned along a top front end of a barrel covering of a firing arm, and being secured thereto. The housing of the front sight has a rear portion, a front portion, and a tritium vial therein. The vial of the housing of the front sight has a back end and a light emitting end contained therein. Also, included is a rear sight that has a rear mounting portion with a pair of housing units thereon. The rear mounting portion is secured to a top rear end of the covering of the barrel of the firearm. Each housing unit of the rear sight has a tritium vial with a back end a light emitting end contained therein. Lastly, each tritium vial of the housing of the front sight and the housing units of the rear sight is self luminous to emit a light beam.

2 Claims, 3 Drawing Sheets

STEALTH SIGHT DEVICE

BACKGROUND OF THE INVENTION

1. Field of the Invention

The present invention relates to a stealth sight device and more particularly pertains to providing a night sight device that shrouds the light being emitted by the tritium vial encapsulated within the sight housing, and further allowing use of the stealth sight device at night where only the viewer can see the light being emitted.

2. Description of the Prior Art

The use of a sight apparatus is known in the prior art. More specifically, sight apparatus heretofore devised and utilized for the purpose of aim assistance at night are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,279,061 to Betz and Thomas discloses a sight apparatus for firearms. U.S. Pat. No. 5,208,989 to Sanders discloses a sight viewing apparatus. U.S. Pat. No. 5,201,122 to Annunziata discloses an aim assist device for a weapon. U.S. Pat. No. 5,068,969 to Sieburt discloses a lighted gun sight. U.S. Pat. No. 5,065,538 to Allan discloses a nocturnal rifle sight organization. Lastly, U.S. Pat. No. 4,434,560 to Comeyne discloses an aiming aide for an aiming device in a low light level environment.

While these devices fulfill their respective, particular objectives and requirements, the aforementioned patents do not describe a stealth sight device that allows a firearm user to use a sight emitting light produced by a tritium vial during night shoots, with each sight having a shroud for concealing the light beam from the adversary.

In this respect, the stealth sight device according to the present invention substantially departs from the conventional concepts and designs of the prior art, and in doing so provides an apparatus primarily developed for the purpose of providing a night sight device that shrouds the light being emitted by the tritium vial encapsulated within the sight housing, and further allowing use of the stealth sight device at night where only viewer can see the light being emitted.

Therefore, it can be appreciated that there exists a continuing need for a new and improved stealth sight device which can be used for providing a night sight device that shrouds the light being emitted by the tritium vial encapsulated within the sight housing, and further allowing use of the stealth sight device at night where only viewer can see the light being emitted. In this regard, the present invention substantially fulfills this need.

SUMMARY OF THE INVENTION

In view of the foregoing disadvantages inherent in the known types of sight apparatus now present in the prior art, the present invention provides an improved stealth sight device. As such, the general purpose of the present invention, which will be described subsequently in greater detail, is to provide a new and improved stealth sight device and method which has all the advantages of the prior art and none of the disadvantages.

To attain this, the present invention essentially includes a front sight. The front sight has a generally rectangular housing positioned on a generally pyramidal front mounting portion. The front mounting portion is positioned along a top front end of a barrel covering of a firing arm. The front mounting portion is secured to the covering top with a front dove-tail slot. Each front dove-tail slot in interconnected to the barrel covering. The front mounting portion has a pair of inclined walls with a pair of vertical walls therebetween. The housing of the front sight has a rear portion and a front portion. The rear portion and the front portion extend beyond each of the inclined walls of the front mounting portion. The housing of the front sight has a tritium vial with a back end and a light emitting end contained therein. The back end is positioned within a casing. The light emitting end has a small portion of a length extending into a shroud of the housing. Also included is a rear sight. The rear sight has a pyramidal rear mounting portion with a pair of generally rectangular housing units thereon. The rear mounting portion has a pair of inclined walls with a pair of vertical walls therebetween. The rear mounting portion is secured with a rear dove-tail slot to a top rear end of the covering of the barrel of the firearm. The rear mounting portion has a concave cutout in a top of each housing unit. Each housing unit has a rear wall integral with one of the inclined walls of the rear mounting portion. Each housing unit of the rear sight has a tritium vial with a back end and a light emitting end contained therein. Each back end is positioned within a casing. Each tritium vial of the housing of the front sight and the housing units of the rear sight is self luminous. Each vial is constantly energized by the reaction life of the tritium within the vial. Lastly, the shroud of the housing of the front sight and the housing units of the rear sight is generally conical in shape. Each shroud has a length of about 0.5 cm to about 2.5 cm. Each shroud of the rear sight is partially cut away by the concave cutout of each. Each shroud of the front sight has a diameter of about 3 mm to about 7 mm. Each shroud of the rear sight has a diameter that increases from front to back. The length and diameter of each shroud is capable of reducing the light beam that is emitted by each vial.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stealth sight device which has all of the advantages of the prior art sight apparatus and none of the disadvantages.

It is another object of the present invention to provide a new and improved stealth sight device which may be easily and efficiently manufactured and marketed.

It is further object of the present invention to provide a new and improved stealth sight device which is of durable and reliable constructions.

An even further object of the present invention is to provide a new and improved stealth sight device which is susceptible of a low cost of manufacture with regard to both materials and labor, and which accordingly is then susceptible of low prices of sale to the consuming public, thereby making such stealth sight device economically available to the buying public.

Still yet another object of the present invention is to provide a new and improved stealth sight device which provides in the apparatuses and methods of the prior art some of the advantages thereof, while simultaneously overcoming some of the disadvantages normally associated therewith.

Even still another object of the present invention is to provide a stealth sight device for providing a night sight device that shrouds the light being emitted by the tritium vial encapsulated within the sight housing, and further allowing use of the stealth sight device at night where only viewer can see the light being emitted.

Lastly, it is an object of the present invention to provide a new and improved stealth sight device that has a front sight. The front sight that has a housing positioned on a front mounting portion. The front mounting portion is positioned along a top front end of a barrel covering of a firing arm, and being secured thereto. The housing of the front sight has a rear portion, a front portion, and a tritium vial therein. The vial of the housing of the front sight has a back end and a light emitting end contained therein. Also, included is a rear sight that has a rear mounting portion with a pair of housing units thereon. The rear mounting portion is secured to a top rear end of the covering of the barrel of the firearm. Each housing unit of the rear sight has a tritium vial with a back end a light emitting end contained therein. Lastly, each tritium vial of the housing of the front sight and the housing units of the rear sight is self luminous to emit a light beam.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
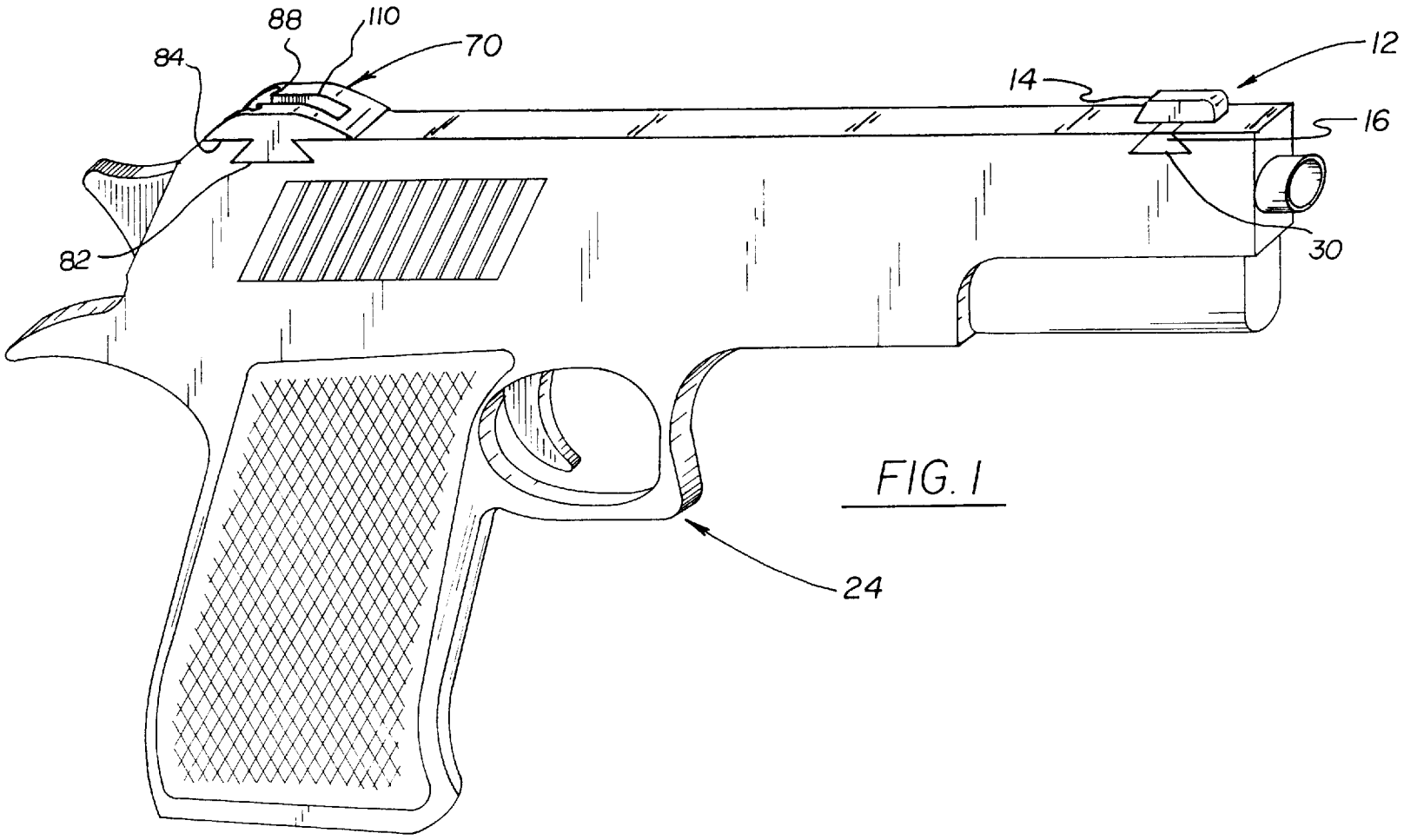
FIG. 1 is a perspective view of the preferred embodiment of the stealth sight device constructed in accordance with the principles of the present invention.

With reference now to the drawings, and in particular to FIG. 1 thereof, the preferred embodiment of the new and improved stealth sight device embodying the principles and concepts of the present invention and generally designated by the reference numerals 12 and 70 will be described.

The present invention, the stealth sight device 12 and 70 is comprised of a plurality of components. Such components in their broadest context include a front sight, a rear sight and a tritium vial. Such components are individually configured and correlated with respect to each other so as to attain the desired objective.

Figure 2:
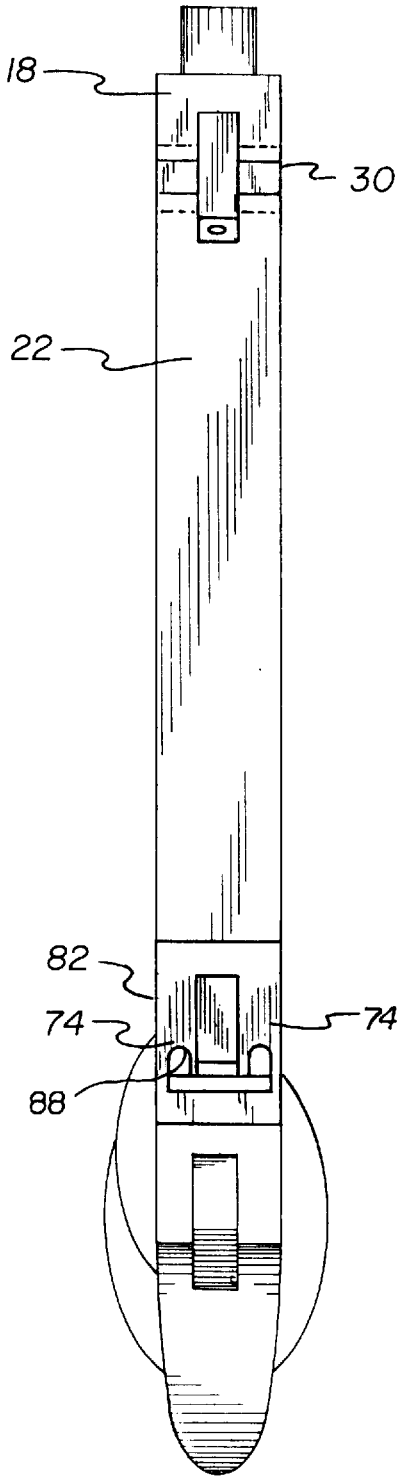
FIG. 2 is a top plan view of the present invention in an operable configuration.
Figure 4:
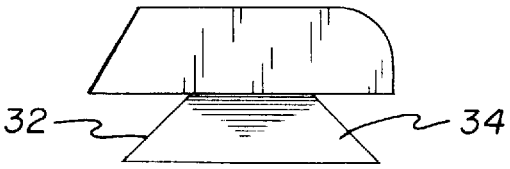
FIG. 4 is a side elevation view of the front sight of the present invention.

Specifically, the present invention includes a front sight 12. As shown in FIG. 1, the front sight has a generally rectangular housing 14 positioned on a generally pyramidal front mounting portion 16. As best illustrated in FIG. 2, the front mounting portion is positioned along a first top end 18 of a barrel covering 22 of a firingarm 24. The front mounting portion is secured to the covering top with a front dove-tail slot. The front dove-tail slot 30 is interconnected to the barrel covering. The front dove-tail slot projects upwardly from the barrel covering. The front mounting portion slides into the front dove-tail slot. The front mounting portion enters the front dove-tail slot from the side of the front slot. The front mounting portion has a pair of inclined walls 32 with a pair of vertical walls 34 therebetween, as shown in FIG. 4. The top of the front mounting portion is integral with the housing. The front mounting portion, when slid into the front dove-tail slot, is held firmly therein. The vertical walls of the front mounting portion and the side walls of the front dove-tail slot are flush with the side of the barrel covering, as shown in FIG. 1.

Figure 6:
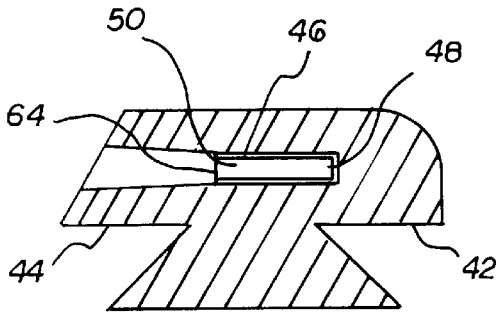
FIG. 6 is a side view of the rear sight of the present invention having a portion cut away in order to better illustrate the operable components.
Figure 7:
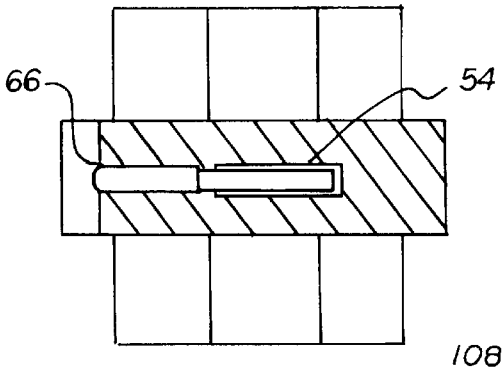
FIG. 7 is a top view of the front sight and having a portion cut away to better illustrate the operable components of the front sight.

The housing 14 of the front sight 12 has a front portion 42 and a rear portion 44 with a reclining face. The rear portion and the front portion extend beyond each of the inclined walls 32 of the front mounting portion 16. FIGS. 4 and 6 show the rear portion and the front portion as they extend beyond the inclined walls. The housing of the front sight has a tritium vial 46 with a front end 48 and a light emitting end 50 contained therein. The front end, as in FIGS. 6 and 7, is positioned within a casing 54. The casing is formed of glass and covers one-hundred percent of the circumference of the tritium vial. The housing and the front mounting portion are both formed from a metal such as steel or titanium.

Figure 5:
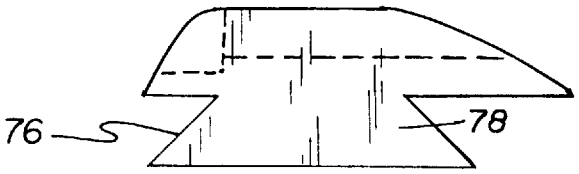
FIG. 5 is a side elevation view of the rear sight of the present invention.

As illustrated in FIG. 1, a rear sight 70 is included. The rear sight has a pyramidal rear mounting portion 72 with a pair of generally rectangular housing units 74 thereon. FIG. 5 shows the rear mounting portion with a pair of inclined walls 76 and a pair of vertical walls 78 therebetween. The rear mounting portion is secured by a rear dove-tail slot 82 to a second top end 84 rearwardly the front sight of the barrel covering 22 of the firearm 24.

The rear mounting portion slides into the rear dovetail slot. The rear mounting portion enters the rear dove-tail slot from the side of the rear slot. The rear mounting portion, when slid into the rear dove-tail slot, is held firmly within. The vertical walls of the rear sight and the side walls of the rear slot are flush with the side of the barrel covering. The rear mounting portion has a concave cutout 88 in the top of each housing unit, as shown in FIG. 2. Each cutout allows the shooter to view the target ahead while aligning the front and rear sights.

Figure 8:
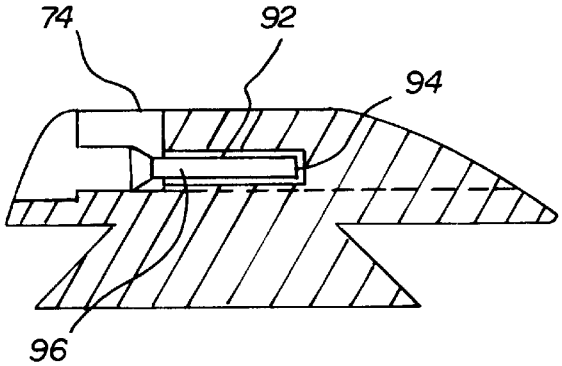
FIG. 8 is a side view of the rear sight having a portion cut away to show the operable components of the rear sight.
Figure 9:
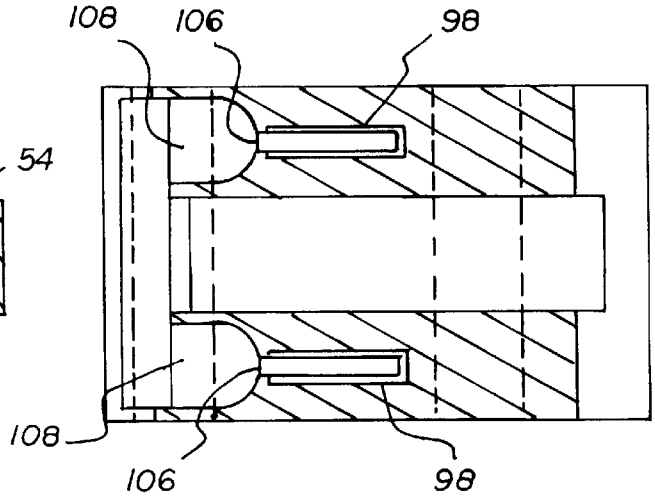
FIG. 9 is a top view of the rear sight having a portion cut away to best illustrate the functional components the rear sight.

FIG. 8 shows each housing unit 74 has a rear wall that is integral with one of the inclined walls of the rear mounting portion 72. Each housing unit of the rear sight has a tritium vial 92 with a front end 94 and a light emitting end 96 contained therein. As illustrated in FIG. 9, each front end is positioned within a casing 98. Each casing of the rear sight is formed of glass and covers ninety percent of the circumference of the tritium vial. Each light emitting end of each vial of each housing unit has a rear portion 106 flush with a shroud 108 of each housing unit. The housing units and the rear mounting portions are formed from a metal such as steel or titanium. Each housing unit of the rear sight is separated by a gap 110.

Each tritium vial 46 and 92 of the housing 14 of the front sight and the housing units 74 of the rear sight are self luminous. Each tritium vial is an isotope of hydrogen and a by product of a nuclear reaction. Each vial is secured within the glass casing with an epoxy or rubber mounting material. A light beam is constantly emitted from each tritium vial. Each vial remains energized through out the reaction life of the tritium. Once the reaction life ends the vials are removed and replaced.

Lastly, the shroud 66 and 108 of the housing of the front sight and the housing units of the rear sight is generally conical in shape. Each shroud of the rear sight is partially cut away the concave cutout of each. Each shroud has a length of about 0.5 cm to about 2.5 cm. The diameter of the front shroud 66 is about 3 mm to about 7 mm. The diameter of the rear shroud 108 increases from front to back. The back of each rear shroud has a diameter that is larger that the front shroud which is smaller.

The length and diameter of each shroud allows the shroud to reduce the light beam being emitted beyond the front and rear sight. Reduction of the light beam will ensure that the beam is not seen by the adversary. Furthermore, because of the direction of the front sight and rear sight, the light that is emitted is in the direction of the firearm user.

Figure 3:
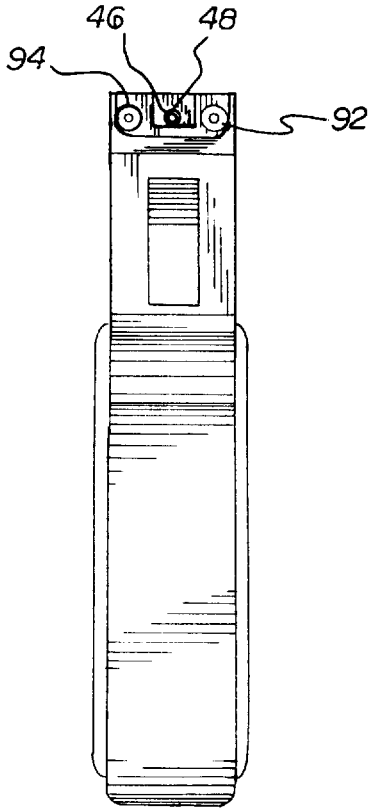
FIG. 3 is a rear view of the firearm of the present invention showing the alignment of the front and rear sights.

FIG. 3 shows the front sight and rear sight in alignment, as seen by the shooter. When the target, is in alignment, the top of the front sight appears to be flush with the top of the rear sight. Also, there must be equal amounts of day light between the gap 110 of the rear sight and the front sight for alignment.

The present invention provides a night sight that shrouds the light emitting beam of the front and rear sights from the view of the adversary. The front and rear sights contain a tritium vial that is self illuminating. The light, that is emitted from each vial, passes through the shroud of the front and rear sight. As the light passes through the shroud, the shooter can see the light beam that is emitted and aligns the light beams when aiming at his target. The amount of the light that is being emitted is considerably reduced by the shroud and enables only the shooter to see the light beam emitted. The present invention, as shown, is mounted on a pistol in the usual fashion. The invention in its current structure may be mounted on the barrel of a rifle. The front and rear sights are both dent proof, easy to assemble and attachable to the barrel covering of the pistol in the present invention. This particular sight design will be most beneficial to law enforcement agents, military special operations, and those needing to use a sight during night maneuvers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved stealth sight device being positioned on a firearm to assist in aiming at a target at night comprising in combination:

a front sight having a generally rectangular housing positioned on a generally pyramidal front mounting portion, the front mounting portion being positioned along a first top end of a barrel covering of a firearm, the front mounting portion being secured to the covering top with a front dove-tail slot, said front dove-tail slot being interconnected to the barrel covering, the front mounting portion having a pair of inclined walls with a pair of vertical walls therebetween, the front mounting portion being slid into the front dove-tail slot;

the housing of the front sight having a front portion and a rear portion with a reclining face, the rear portion and the front portion extending beyond each of the inclined walls of the front mounting portion, the housing of the front sight having a tritium vial with a front end and a light emitting end contained therein, the front end being positioned within a casing, the light emitting end having a small portion of a length extending into a shroud of the housing;

a rear sight having a pyramidal rear mounting portion with a pair of generally rectangular housing units thereon, the rear mounting portion having a pair of inclined walls with a pair of vertical walls therebetween, the rear mounting portion being secured with a rear dove-tail slot to a second top end rearwardly the front sight of the covering of the barrel of the firearm, the rear mounting portion having a concave cutout in a top of each housing unit;

each housing unit having a rear wall integral with one of the inclined walls of the rear mounting portion, each housing unit of the rear sight having a tritium vial with a front end and a light emitting end contained therein, each front end being positioned within a casing, each light emitting end of each vial of each housing unit having a front portion being flush with a shroud of each housing unit;

each tritium vial of the housing of the front sight and the housing units of the rear sight being self illuminating, each vial being constantly energized by the reaction life of the tritium within the vial; and the shroud of the housing of the front sight and the housing units of the rear sight being generally conical in shape, each shroud having a length of about 0.5 cm to about 2.54 cm, each shroud of the rear sight being partially cut away by the concave cutout of each, each shroud of the front sight having a diameter of about 3 mm to about 7 mm, each shroud of the rear sight having a diameter increasing from front to back, the length and diameter of each shroud being capable of reducing the light beam being emitted by each vial.

2. A stealth sight device comprising:

a front sight having a housing positioned on a front mounting portion, the front mounting portion being positioned along a first front end of a barrel covering of a firearm and being secured thereto, the housing of the front sight having a rear portion, a front portion, and a tritium vial therein, the vial of the housing of the front sight having a front end and a light emitting end contained therein;

a front dove-tail slot being interconnected to the barrel covering for slidable receipt of the front mounting portion therein, and the front mounting portion having a pair of inclined walls with a pair vertical walls therebetween;

the front end of the housing of the front sight having the tritium vial being positioned within a casing, the casing being formed of glass, and the light emitting end having a small portion of a length extending into a shroud of the housing of the front sight;

a rear sight having a rear mounting portion with a pair of housing units thereon, the rear mounting portion being secured to a second top end of the covering of the barrel of the firearm, each housing unit of the rear sight having a tritium vial with a front end and a light emitting end contained therein, each front end of the housing of the rear sight having the tritium vial being positioned within a casing made from glass, each light emitting end of each vial of each housing unit of the rear sight having a small portion of a length extending into a shroud of each housing unit;

the rear mounting portion having a pair of inclined walls with a pair of vertical walls therebetween, and each housing unit having a rear wall integral with one of the inclined walls of the rear mounting portion, the second top end of the barrel covering having a rear dove-tail slot for slidable receipt of the rear mounting portion therein;

the housing of the front sight and each housing unit of the rear sight having a shroud being generally conical in shape, each shroud having a length of about 0.5 cm to about 2.54 cm, the length and diameter of each shroud being capable of reducing the light beam being emitted by each vial; and each tritium vial within each housing of the front and rear sight being continuously energized through out the reaction life of the tritium within.

* * * * *